US010551077B2

(12) United States Patent
Harel et al.

(10) Patent No.: US 10,551,077 B2
(45) Date of Patent: Feb. 4, 2020

(54) BUILDING STRUCTURE FOR A MULTI-STORY BUILDING

(71) Applicants: TADIRAN GROUP LTD, Petach Tikva (IL); Eitan Harel, Beit Yehoshua (IL)

(72) Inventors: Eitan Harel, Beit Yehoshua (IL); Avi Elyahu Cohen, Rosh Haayin (IL)

(73) Assignees: TADIRAN GROUP LTD, Petah Tikva (IL); Eitan Harel, Beit Yehoshua (IL)

( * ) Notice: Subject to any disclaimer, the term of this patent is extended or adjusted under 35 U.S.C. 154(b) by 198 days.

(21) Appl. No.: 15/517,001

(22) PCT Filed: Sep. 24, 2015

(86) PCT No.: PCT/IL2015/050975
§ 371 (c)(1),
(2) Date: Apr. 5, 2017

(87) PCT Pub. No.: WO2016/055995
PCT Pub. Date: Apr. 14, 2016

(65) Prior Publication Data

US 2017/0299204 A1 Oct. 19, 2017

Related U.S. Application Data

(60) Provisional application No. 62/060,647, filed on Oct. 7, 2014.

(30) Foreign Application Priority Data

Jul. 13, 2015 (IL) ..... 239916

(51) Int. Cl.
*F24F 1/68* (2011.01)
*E04F 17/04* (2006.01)
(Continued)

(52) U.S. Cl.
CPC ..... *F24F 1/68* (2013.01); *E04F 17/02* (2013.01); *E04F 17/04* (2013.01); *E04F 17/08* (2013.01);
(Continued)

(58) Field of Classification Search
CPC .... F24F 1/68; F24F 1/0003; F24F 1/60; F24F 7/60; F24F 7/065; F24F 2007/001;
(Continued)

(56) References Cited

U.S. PATENT DOCUMENTS 4,219,011 A * 8/1980 Knoos ..... F24S 10/80 126/666
4,965,974 A * 10/1990 LeBow ..... E04B 1/24 52/301
2016/0249484 A1* 8/2016 Parizeau ..... H05K 7/20745

FOREIGN PATENT DOCUMENTS

EP 806615 A2 11/1997
EP 1184627 A1 3/2002
(Continued)

OTHER PUBLICATIONS

Translation JPS53101439U.*
(Continued)

*Primary Examiner* — Elizabeth J Martin
(74) *Attorney, Agent, or Firm* — Venable LLP; Jeffri A. Kaminski

(57) ABSTRACT

A structure for a multi-story building comprises a first passageway constructed internally within a building being configured with a mount for a ducted condenser unit (DCU) of a split type, unitary air conditioning system to achieve a desired level of condenser based heat dissipation and with a plurality of penetrations to accommodate a conduit through which refrigerant circulates between inside and outside units of the air conditioning system; and a second passageway
(Continued)

constructed internally within the building for receiving air discharged from the DCU the second passageway terminating at an opening of the building through which the discharged air is exhausted to the atmosphere. The passageways have walls that are essentially closed, with the exception of the wall that is formed with an opening through which the discharged air flows. One or both of the first and second passageways upwardly extends across at least two stories of the building.

20 Claims, 13 Drawing Sheets

(51) Int. Cl.

| | |
|---|---|
| ***F24F 1/0003*** | (2019.01) |
| ***F24F 1/60*** | (2011.01) |
| ***F24F 7/06*** | (2006.01) |
| ***E04F 17/02*** | (2006.01) |
| ***E04F 17/08*** | (2006.01) |
| ***F24F 7/00*** | (2006.01) |

(52) U.S. Cl.
CPC ..... *F24F 1/0003* (2013.01); *F24F 7/06* (2013.01); *F24F 2007/001* (2013.01); *F24F 2221/50* (2013.01)

(58) Field of Classification Search
CPC ..... F24F 2221/50; F24F 7/04; E04F 17/02; E04F 174/04; E04F 17/08
See application file for complete search history.

(56) References Cited

FOREIGN PATENT DOCUMENTS

| | | | | |
|---|---|---|---|---|
| JP | S53101439 | U | * | 8/1978 |
| JP | H02282637 | A | | 11/1990 |
| JP | 2014020748 | A | | 2/2014 |
| WO | 2009066189 | A1 | | 5/2009 |
| WO | 2010052594 | A1 | | 5/2010 |

OTHER PUBLICATIONS

International Search Report of PCT/IL2015/050975, dated Jan. 13, 2016.
Written Opinion of PCT/IL2015/050975, dated Jan. 13, 2016.
International Preliminary Report on Patentability for PCT/IL2015/050714, dated Dec. 26, 2016.

* cited by examiner

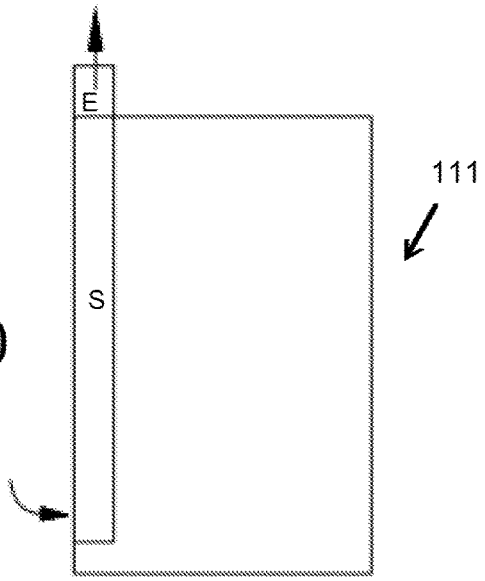
Fig. 20
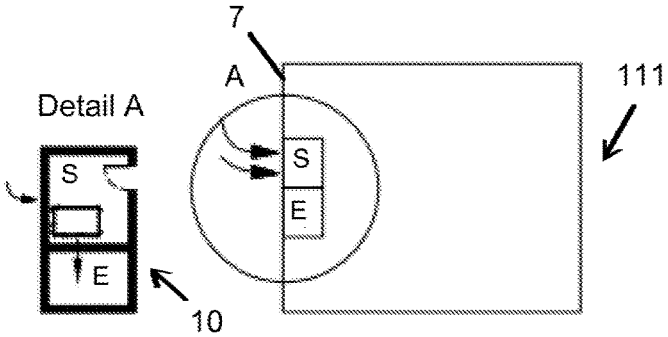
Fig. 21
Fig. 19
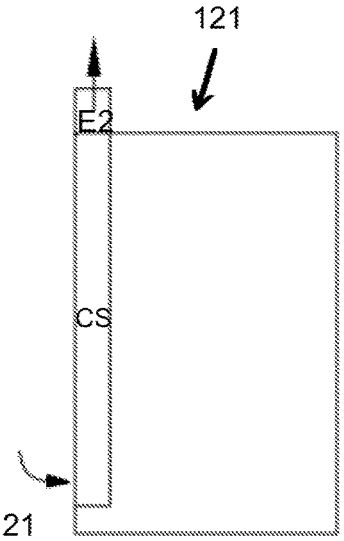
Fig. 23
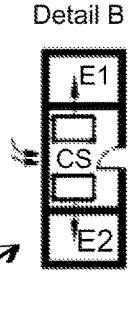
Fig. 24
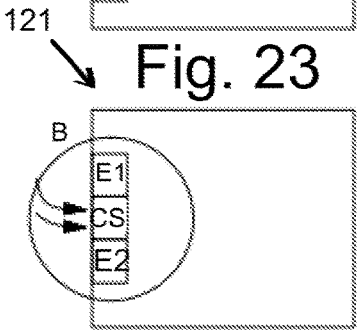
Fig. 22

BUILDING STRUCTURE FOR A MULTI-STORY BUILDING

CROSS-REFERENCES TO RELATED APPLICATIONS

This application is a U.S. National Stage application of PCT/IL2015/050975, filed 24 Sep. 2015 and published on 14 Apr. 2016 as WO 2016/055995, which claims the benefit of U.S. Provisional Patent Application No. 62/060,647, filed 7 Oct. 2014 and Israeli Patent Application No. 239916, filed 13 Jul. 2015, all of which are hereby incorporated by reference in their entireties.

FIELD OF THE INVENTION

The present invention relates to the field of building structures. More particularly, the invention relates to a building structure for a multi-story building that is conducive to the flow of air for use in an air conditioning system.

BACKGROUND OF THE INVENTION

For the development of large multi-story buildings, the developer faces a choice between two categories of air conditioning systems—central and unitary.

FIG. 1 schematically illustrates a central air conditioning system for a multi-story building, which generally comprises a plurality of water-cooled air conditioners 1, often referred to as "water source units", within the building 6, an outdoor cooling tower 3, and a conduit circuit 2 by which heat ejected from the water source units is carried by recirculating water to the cooling tower, is disadvantageous in that a large common area associated with a high maintenance facility has to be allocated to accommodate the cooling tower. A bothersome air plume 4 characterized by hot and usually humid air is discharged from the cooling tower 3. Another disadvantage of this arrangement is that the system is inefficient, particularly when used in a multi-tenant building, in order to provide cooling needs during partial loads, leading to higher monthly common expenses for all tenants.

A unitary system by which the air conditioning related electrical consumption is independently billed per apartment is therefore commonly used in multi-tenant buildings.

The most popular unitary system is a split unit system wherein each apartment has an outdoor unit that includes a compressor and a condenser, and an indoor unit consisting of an evaporator and a fan for drawing the interior air across the evaporator so that the conditioned air will be discharged via supply ducts to the space to be conditioned. Conduits through which refrigerant flows in a closed cooling or heating cycle extend between the outdoor and indoor units.

With respect to the split system, however, the developer is forced to surrender the income generating habitable space of the apartment, as well as attractive external surfaces adjacent to the facade to accommodate the outdoor unit mountings. The architect has to integrate, as shown in FIGS. 2-5, large external louvers 8 with the facade 7 for a combined air intake and discharge for use of the outdoor unit 5. A further disadvantage of the split system is that adjacent buildings have to be sufficiently separated due to the noise generated by the outdoor units and due to the lateral space occupied by the mountings.

It is an object of the present invention to provide a building structure that facilitates the installation of a split type, unitary air conditioning system that is individualized for each tenant, yet does not detract from the appearance or the dimensions of the facade.

It is an additional object of the present invention to provide a building structure that allows the use of internally located and inconspicuous areas of the building, rather than the highly visible facade or roof as has practiced heretofore with respect to prior art building structures, for the positioning of the outdoor units of an air conditioning system.

It is an additional object of the present invention to provide a building structure that facilitates the installation of a split type, unitary air conditioning system that minimizes bothersome air discharge.

Other objects and advantages of the invention will become apparent as the description proceeds.

SUMMARY OF THE INVENTION

The present invention provides a building structure for a multi-story building, comprising a first passageway constructed internally within said building being configured with one or more mounts for a ducted condenser unit of a split type, unitary air conditioning system which facilitates sufficient air flow therethrough for achieving a desired level of condenser based heat dissipation to maximize efficiency of said air conditioning system and with a plurality of penetrations to accommodate the extension therethrough of a fluid circuit conduit through which refrigerant circulates between an inside unit and an outside unit of said air conditioning system; and a second passageway constructed internally within said building and in fluid communication with said first passageway to receive air discharged from the ducted condenser unit, said second passageway terminating at an opening of said building through which said discharged air is exhausted to the atmosphere, wherein said first and second passageways have walls that are essentially closed, with the exception of the wall that adjoins said first and second passageways and that is formed with an opening through which said discharged air is flowable, and wherein one or both of said first and second passageways upwardly extends across at least two stories of said building.

In one aspect, the first passageway is an upwardly extending suction shaft in fluid communication with at least one air inlet through which ambient air is introducible and the second passageway is an upwardly extending exhaust shaft. The exhaust shaft is in fluid communication with at least one air outlet from which the discharged air is exhaustible to the atmosphere, in addition to the opening at which the exhaust shaft terminates.

When an air inlet of the first passageway is at a top or bottom of the building, or an air outlet of the second passageway is at a top or bottom of the building, the building structure can be additionally advantageous in that the first and/or second passageways can be implemented as ventilation means for an underground parking lot. The vertical shaft that is planned for ventilation may be dual-purpose, to also serve as a mounting for ducted condenser units, thereby minimizing the additional area needed for air conditioning systems. Fire control elements may be installed on the vertical shaft.

In one aspect, the suction shaft is sized to permit a sufficient air flow therethrough such that a plurality of the ducted condenser units, one or more of which is mounted at a different story of the building, simultaneously draw the ambient air which is flowing in the suction shaft across its corresponding condenser for use in heat dissipation.

In one aspect, the suction and exhaust shafts extend along substantially the entire height of the building.

In one aspect, the suction and exhaust shafts are oblique, such that a lower end of the suction shaft has a greater cross-sectional area than at an upper end thereof, to increase the air flow rate within the suction shaft, and the exhaust shaft has a greater cross-sectional area at its upper end than at its lower end to accommodate the higher capacity of upwardly flowing air that has been discharged from all the ducted condenser units therebelow and has accumulated within the exhaust shaft.

In one aspect, the second passageway is an upwardly extending exhaust shaft and the first passageway is a volume disposed between, and in fluid communication with, said exhaust shaft and a suction shaft.

In one aspect, one of the first and second passageways is a horizontal passageway extending from an opening formed in a wall of the building.

In one aspect, the building structure is constructed with protective elements, such as a grating, for preventing people who access the ducted condenser unit from falling within the first passageway, yet enabling continuous and uninhibited flow of air within the first passageway.

In one aspect, a dedicated cavity within which is mountable an exhaust duct of the ducted condenser unit is formed in the adjoining wall. The exhaust duct is detachable from a ducted condenser unit casing, allowing a maintenance worker standing on the grating to access a ducted condenser unit fan via an uncovered discharge opening.

In one aspect, a non-return damper is mounted in the exhaust duct to prevent backflow of the higher pressure discharged air.

In one aspect, one wall of the suction and exhaust shafts is common with an exterior wall of the building, and may have a total open area of only 10-15%.

In one aspect, the wall of the suction and exhaust shafts that is common with an exterior wall of the building is completely closed, and an air inlet and air outlet of the suction and exhaust shafts, respectively, is at a top or bottom of the building.

BRIEF DESCRIPTION OF THE DRAWINGS

In the drawings:

FIGS. 15-24 schematically illustrate various shaft configurations.

DETAILED DESCRIPTION OF PREFERRED EMBODIMENTS

In the building structure of the present invention, the air discharged from an outside unit of a split type, unitary air conditioning system, whether operating in a cooling mode or in a heating mode, is able to flow through a vertical shaft constructed internally to a building. The shaft may be common to a plurality of outside units to minimize construction expenses without substantially detracting from habitable space or from the outside appearance of the building.

Figure 1:
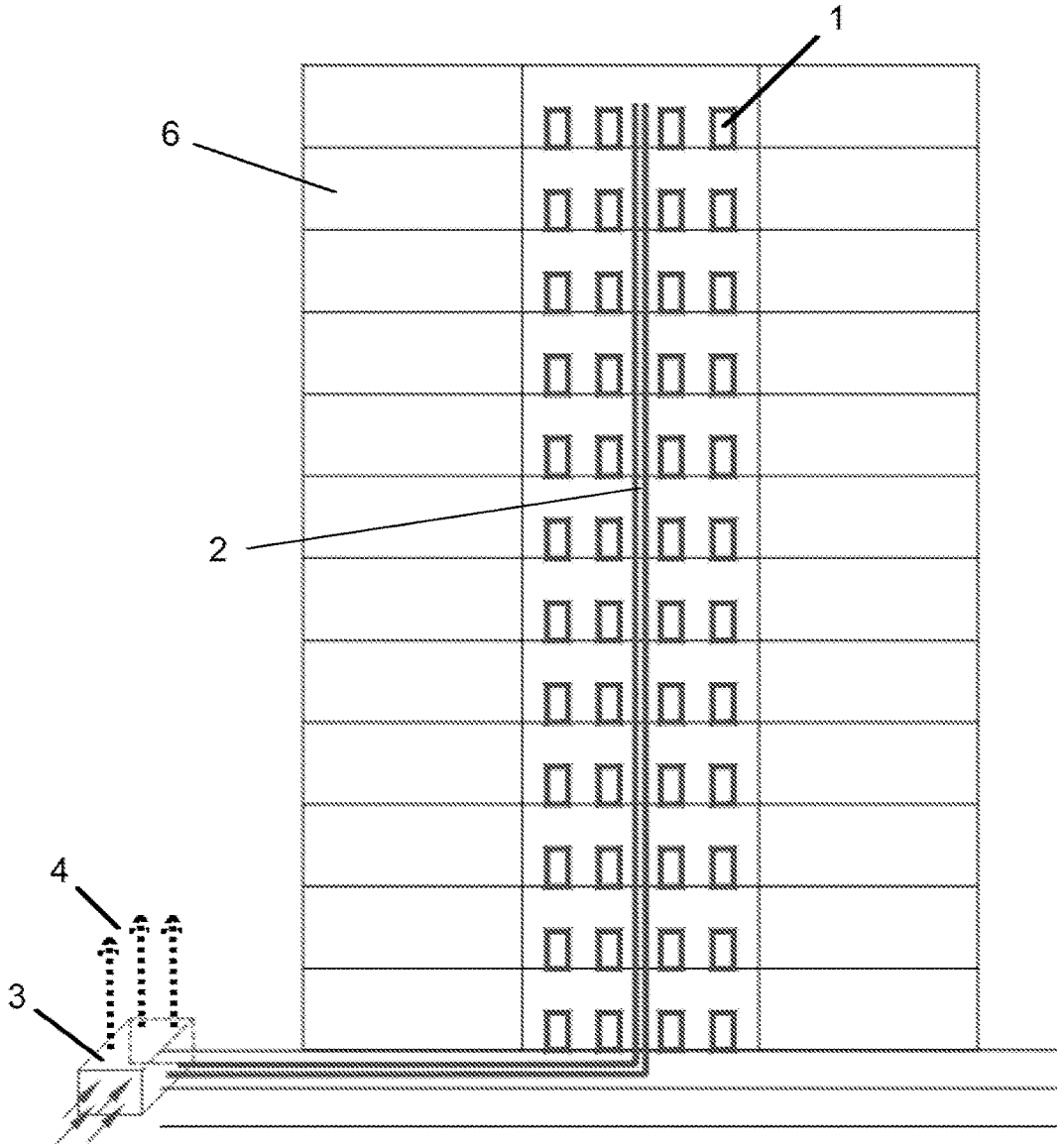
Fig. 1 PRIOR ART
FIG. 1 is a schematic, vertical cross-sectional view of a multi-story building, showing a prior art arrangement for an air conditioning system.
Figure 2:
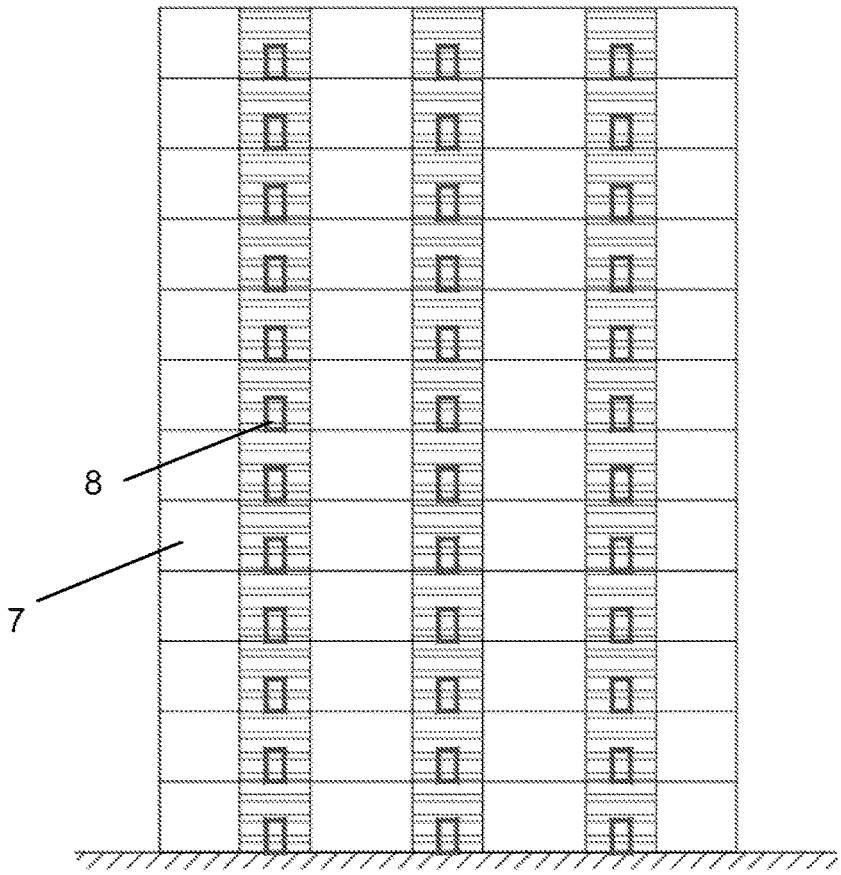
Fig. 2 PRIOR ART
FIGS. 2 and 3 are a front view and a schematic and partial top cross-sectional view, respectively of a multi-story building, showing a prior art structure for facilitating an air conditioning system.
Figure 3:
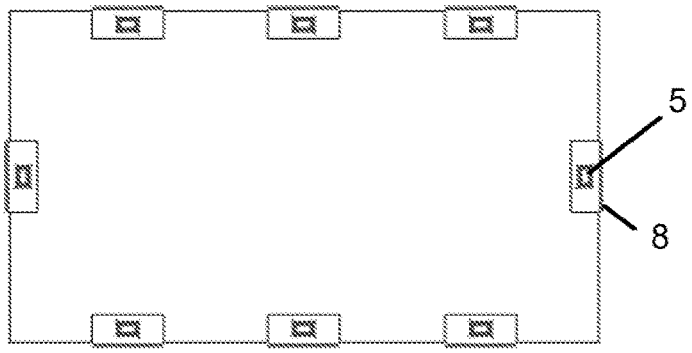
Fig. 3 PRIOR ART
Figure 4:
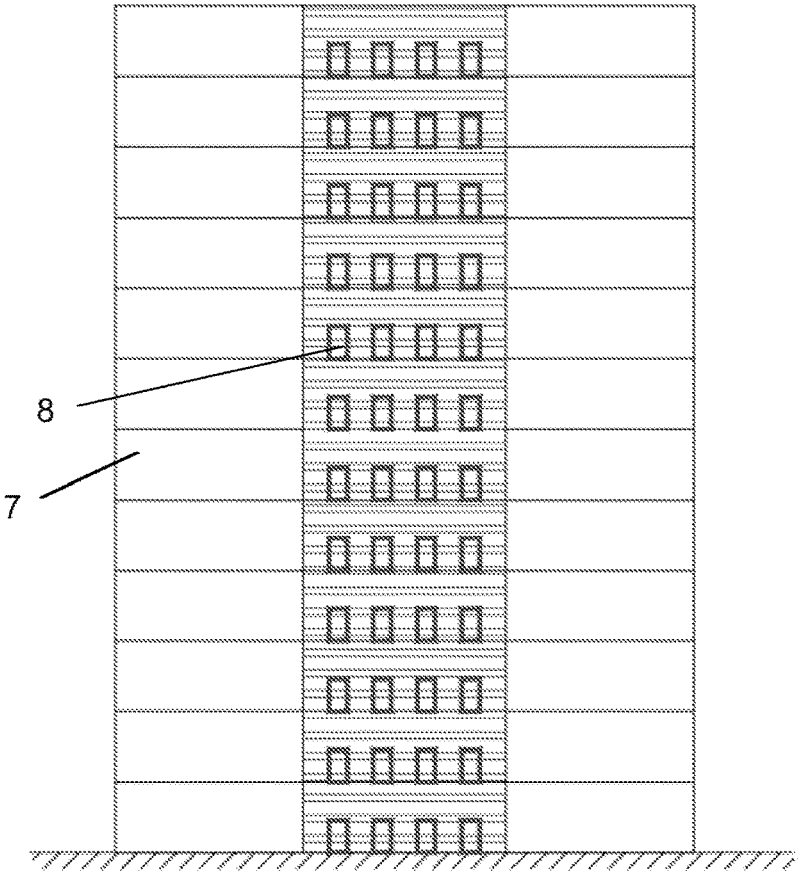
Fig. 4 PRIOR ART
FIGS. 4 and 5 are a front view and a schematic and partial top cross-sectional view, respectively of a multi-story building, showing another prior art structure for facilitating an air conditioning system.
Figure 5:
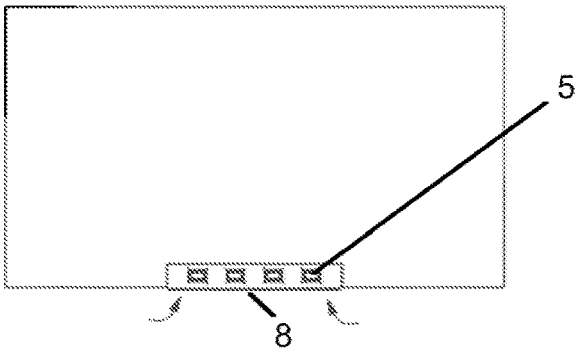
Fig. 5 PRIOR ART
Figure 6:
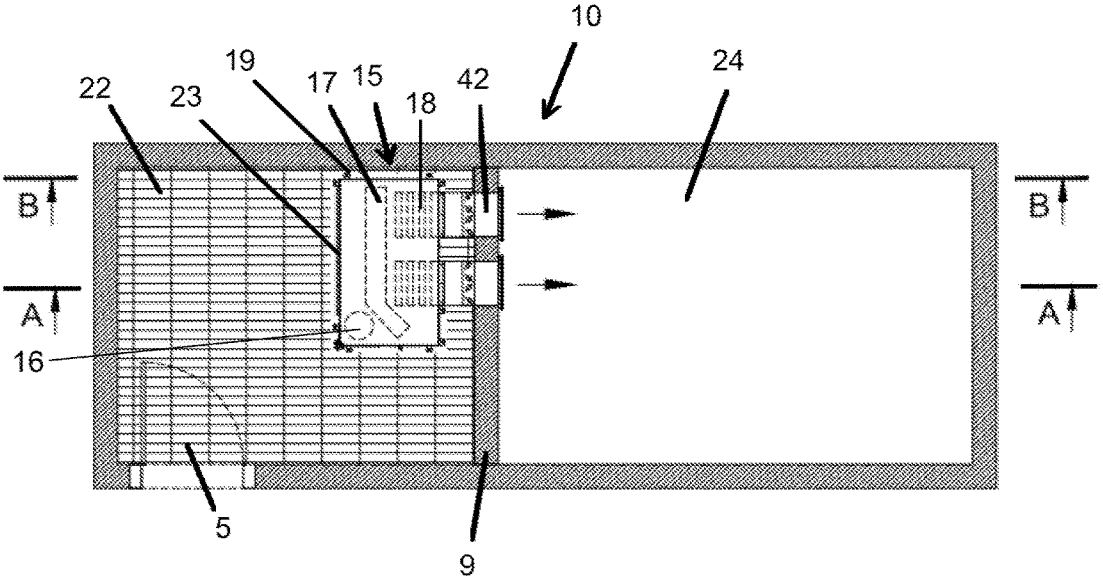
FIG. 6 is a horizontal section of a vertical shaft, schematically illustrating a ducted condenser unit that is mounted therewithin, according to one embodiment of the present invention.

Reference is now made to FIG. 6, which schematically illustrates a horizontal section of a constructed vertical shaft 10, to demonstrate some principles of the invention. In order to utilize the advantages of the vertical shaft construction for the discharge of air from the outside unit of a split type air conditioning system, a ducted condenser unit (DCU), generally indicated by numeral 15, is mounted within vertical shaft 10. DCU 15 constitutes the outside unit of a split type air conditioning system, including compressor 16, condenser 17 and fan 18, generally a centrifugal fan, which are internally mounted to the DCU casing 23, as well as one or more conduits 19 through which refrigerant circulates. The inside unit corresponding to DCU 15 is mounted within an area which is intended to be conditioned.

DCU 15 may provide the air conditioning needs for a single enclosed area. Alternatively, one DCU 15 may be common to a plurality of enclosed areas contiguous with vertical shaft 10.

Vertical shaft 10 is subdivided into a suction shaft 22 through which ambient air flowing therethrough is drawn by DCU 15, and an exhaust shaft 24 through which air discharged from the DCU via one or more exhaust ducts 42 is exhausted to the atmosphere. The discharged air is hot when the DCU is operating in a cooling mode and is cold when the DCU is operating in a heating mode. A dividing wall 9, which is preferably thermally insulated to minimize heat transfer between suction shaft 22 and exhaust shaft 24, is contiguous with both shafts 22 and 24. Each exhaust duct 42 may be mounted in a dedicated cavity formed in dividing wall 9.

Fan 18 draws air from suction shaft 22, and has sufficient power to generate a suitable airflow across condenser 17, and through exhaust ducts 42 and exhaust shaft 24 to maintain efficient operation of DCU 15. For example, a centrifugal fan may be employed with an external static pressure of 80-100 Pascal.

The pressure of the air discharged by DCU 15 to exhaust shaft 24 is higher than the air pressure within suction shaft 22. In one embodiment, to prevent backflow of the higher pressure air from exhaust shaft 24 to suction shaft 22, a non-return damper 8 is installed in each exhaust duct 42.

Figure 7:
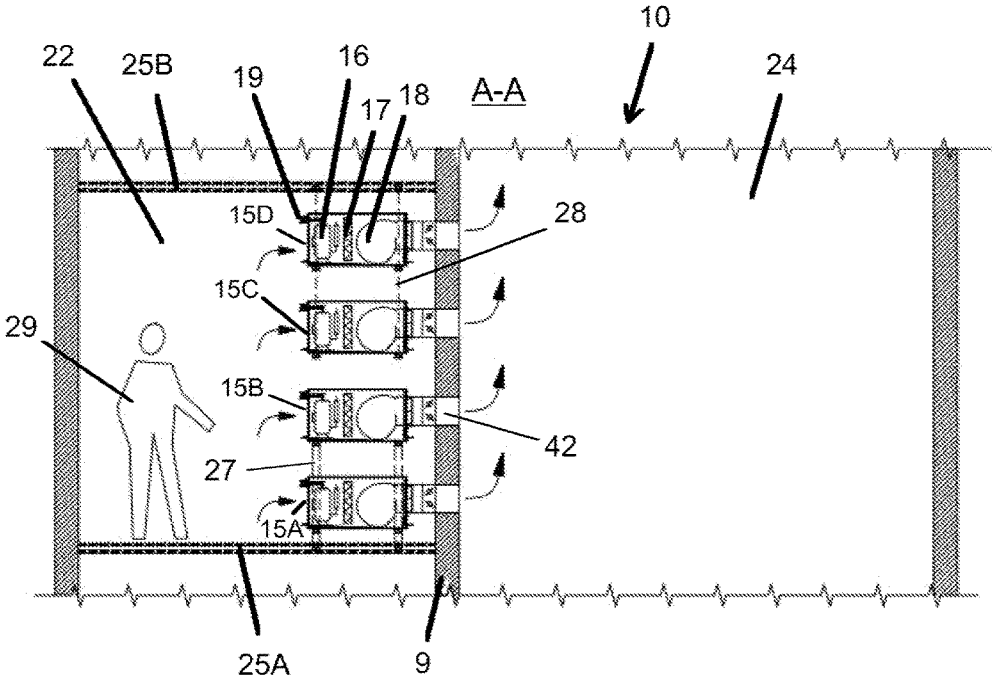
FIG. 7 is a vertical cross-sectional view, cut along plane A-A of FIG. 6 and showing one floor of the vertical shaft.

When a centrifugal fan is employed, the height of DCU 15 is considerably less than that of a prior art outdoor condenser that uses an axial fan, allowing a large number of DCUs to be mounted within a given height, as shown in FIG. 7. According to the exemplary mounting scheme that is illustrated, four DCUs 15A-D are mounted one above the other between two vertically spaced steel gratings 25A-B providing protective support to an operator 29 standing above the lower grating in a given volume. Vertically spaced DCUs 15A-B are mounted on top of lower grating 25A by a plurality of vertical supports 27 extending thereabove. Vertically spaced DCUs 15C-D are suspended from upper grating 25B by a plurality of hangers 28 extending therebelow.

Alternatively, the DCU may be mounted on steel beams, for example with anti-vibration pads or springs. The beams may be connected between adjacent walls of the shaft or the room in which the DCU is mounted. Alternatively, the DCU may be hinged to an upper beam.

When DCU 15 is mounted internally to suction shaft 22 as illustrated, a service door 5, e.g. a fire door, may allow entry to the interior of the suction shaft. The suction shaft interior is protected, for example by the steel grating and rails, or other protective elements to prevent human operators and maintenance workers from falling within the shaft, as well as preventing tools or equipment from falling, yet enabling continuous and uninhibited vertical flow of air within the shaft. Maintenance workers are therefore able to access on-site replaceable components such as a motor, fan and compressor, as shown in FIG. 7.

Alternatively, DCU 15 may be mounted externally to suction shaft 22, for example within a volume between, and in fluid communication with, suction shaft 22 and exhaust shaft 24, by means of one or more ducts, to facilitate sufficient air flow for achieving a desired level of condenser based heat dissipation. With respect to this configuration, the room in which the DCU is mounted may have a conventional solid floor and ceiling, and suction shaft 22 and exhaust shaft 24 do not require any gratings or a service door to be accessed by a maintenance worker.

Figure 8:
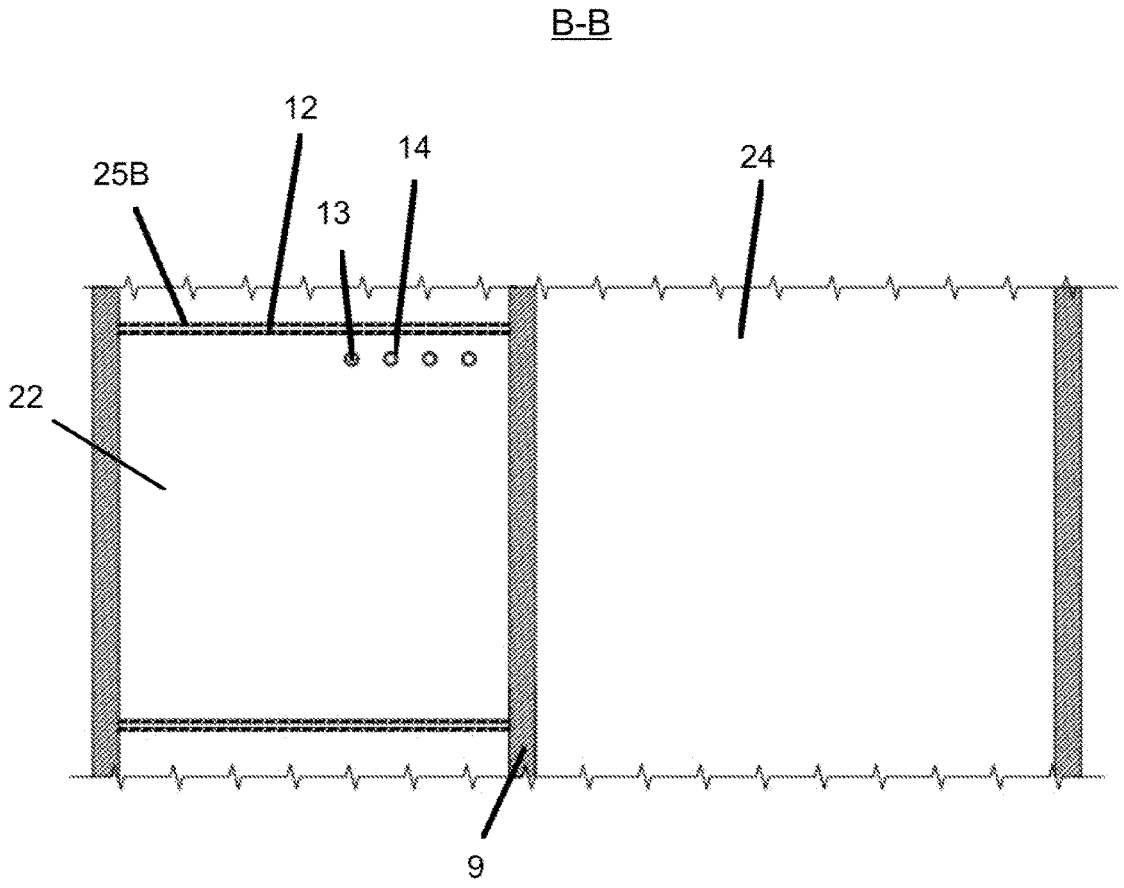
FIG. 8 is a vertical cross-sectional view, cut along plane B-B of FIG. 6 and showing a wall at one floor of the vertical shaft.

FIG. 8 illustrates a wall 12 of suction shaft 22 which adjoins a space of the building which is intended to be conditioned. Wall 12 is formed with a plurality of penetrations, for example penetrations 13 and 14 to accommodate the extension therethrough of fluid circuit conduit 19 (FIG. 6) through which the refrigerant circulates, between the indoor unit and the outdoor unit. For example, conduit 19 extends through penetration 13 from the evaporator of the indoor unit to compressor 16, and then to condenser 17 whereat the compressed refrigerant is condensed. Curved conduit 19 also extends through penetration 14 to the evaporator, so that the condensed refrigerant will be able to be converted to the gaseous phase. Other penetrations in wall 12 may be adapted to receive an electric cable or a conduit through which a fluid for heating water circulates. The penetrations are shown to be located slightly below grating 25B associated with an adjacent upper floor and arranged in collinear fashion, but it will be appreciated that the penetration may be arranged in any other desired fashion.

The components of the DCU may be configured in many different ways. For example, the DCU may be of the fixed speed compressor type, the inverter compressor type, or of the variable refrigerant flow (VRF) type.

Figure 9:
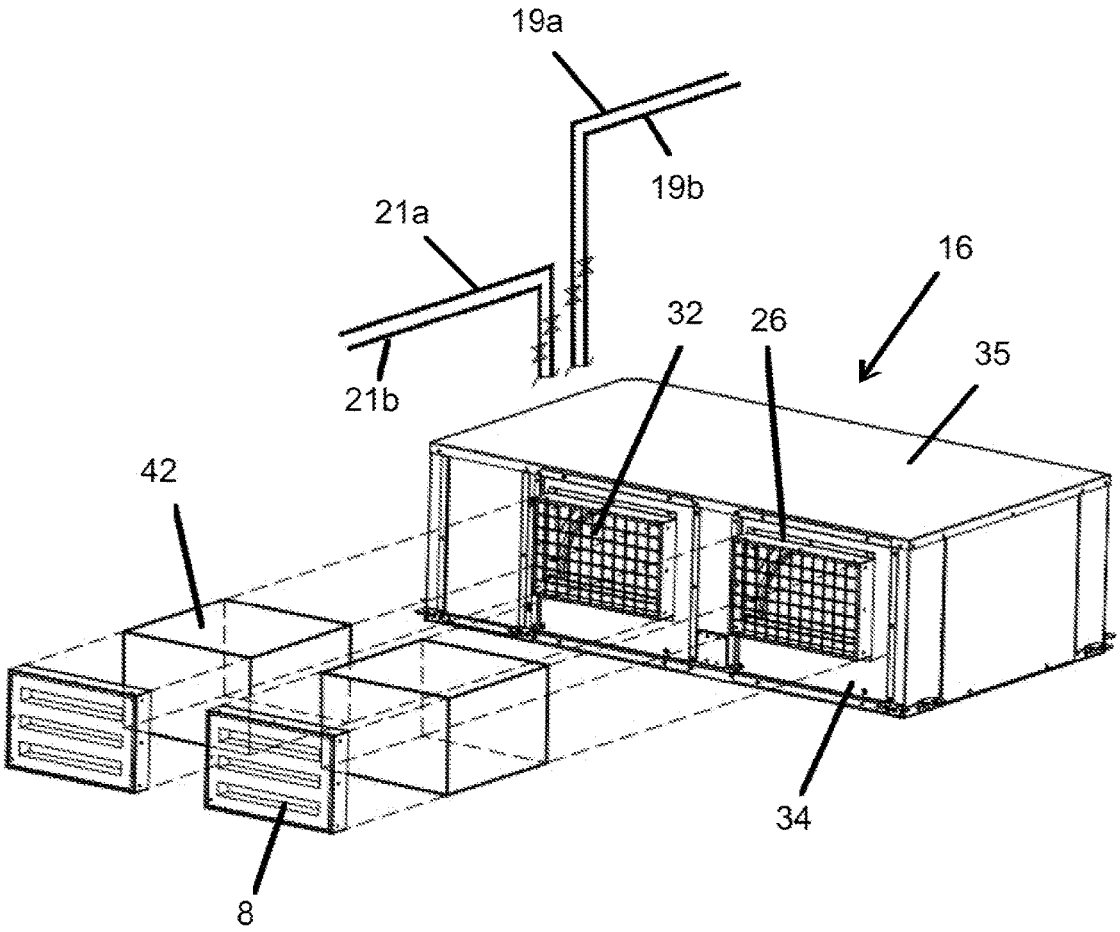
FIG. 9 is an exploded, perspective view of a ducted condenser unit, according to one embodiment of the invention.

FIG. 9 illustrates a DCU 16 according to another embodiment of the invention, shown in a partially exploded and partially schematic view. Casing 35 of DCU 16 is shown to be rectilinear, but it may assume any other desired configuration. Front side 34 of casing 35, i.e. the side facing the exhaust shaft, is formed with two discharge openings, although one opening is also within the scope of the invention. An exhaust duct 42 may be releasably engageable, or alternatively fixedly engageable, with a corresponding set of securing elements 26 that surround a corresponding discharge opening. A non-return damper 8 may be mounted in a corresponding exhaust duct 42.

The provision of releasably engageable exhaust ducts 42 allows casing front side 34 to be disposed rearwardly from the dividing wall, i.e. within the suction shaft, so that maintenance workers will be able to access the fan.

As shown in FIGS. 6 and 7, the standard configuration of DCU 15 is such that the frontwardly disposed fan and motor 18 are generally inaccessible since they are blocked by the rearwardly disposed condenser 17. In prior art maintenance operations, DCU casing 35 would have to be disassembled in order to access fan 18.

By virtue of the releasably engageable exhaust ducts 42, a maintenance worker is able to stand on grating 25*a* between dividing wall 9 and casing front side 34 after ducts 42 have been detached and then access fan 18 via the uncovered discharge opening.

Conduit 19*a*, through which the condensed refrigerant flows from DCU 16, and conduit 19*b*, through which the evaporated refrigerant flows into the DCU, extend between DCU 16 and the inside unit evaporator located within the corresponding air conditioned area.

It will be appreciated that DCU 16 may be provided without any exhaust ducts. When DCU 16 is ductless, each discharge opening may be equipped with a safety grille 32.

Alternatively, a DCU 16 having an exhaust duct 42 may be configured without any non-return dampers.

In another embodiment, DCU 16 may be used to heat water for use in the enclosed areas of the building. A water-refrigerant heat exchanger (not shown) is positioned in heat exchanger relation with high temperature refrigerant, which flows via conduit 21*a* to the heat exchanger. Heat depleted refrigerant at a cooler temperature returns to DCU 16 via conduit 21*b*. On the water side of the heat exchanger, cool water is delivered from a water source to the heat exchanger, and the heated water exiting the heat exchanger is flowable to the consumer, thereby significantly lowering the costs to heat water within the building.

Figure 10:
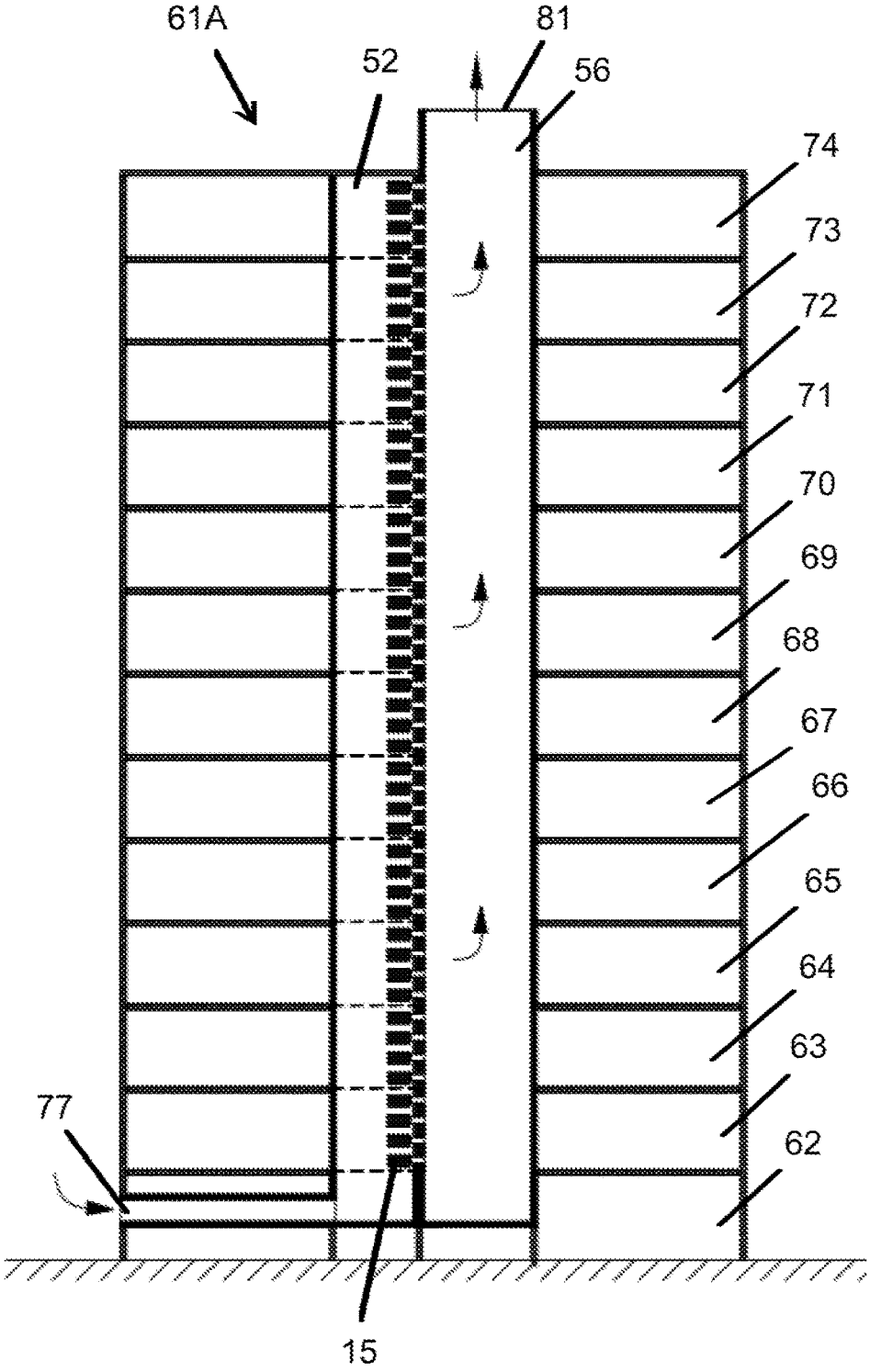
FIGS. 10-13 are four schematic, vertical cross-sectional views, respectively, of four inventive embodiments of a building structure.

In building structure 61A shown in FIG. 10, both suction shaft 52 and exhaust shaft 56 are in fluid communication with each of the floors 62-74 of the building arranged such that floor 74 is the uppermost floor. The building has an air inlet 77 formed at a bottom region thereof, for example below floor 63. The air admitted through inlet 77 flows upwardly through suction shaft 52 into each DCU 15, in order to dissipate heat from the corresponding DCU, when operating in the cooling mode. Four DCUs are shown for example to be mounted within suction shaft 52 at each floor, although any other number is also within the scope of the invention. The air exhausted from each DCU is discharged into exhaust shaft 56, and then flows upwardly towards outlet 81 at the upper end of the exhaust shaft, which may be located above the upper end of the suction shaft. As each DCU is cooled in parallel, the cooling effect is unaffected by the air admitted into an adjacent DCU.

A single air inlet 77 and a single air outlet 81 are sufficient when pressure calculations indicate that the combination of the pressure of the air within suction shaft 52 at uppermost floor 74 and the power of the DCU fan are sufficiently high to provide the cooling needs of the condensers.

Each of suction shaft 52 and extract shaft 56 may extend upwardly from the level of air inlet 77. Suction shaft 52 may terminate at the roof 54 of the building. If so desired, one or more vertical extensions or horizontal extensions may be connected to suction shaft 52 or to extract shaft 56.

Figure 11:
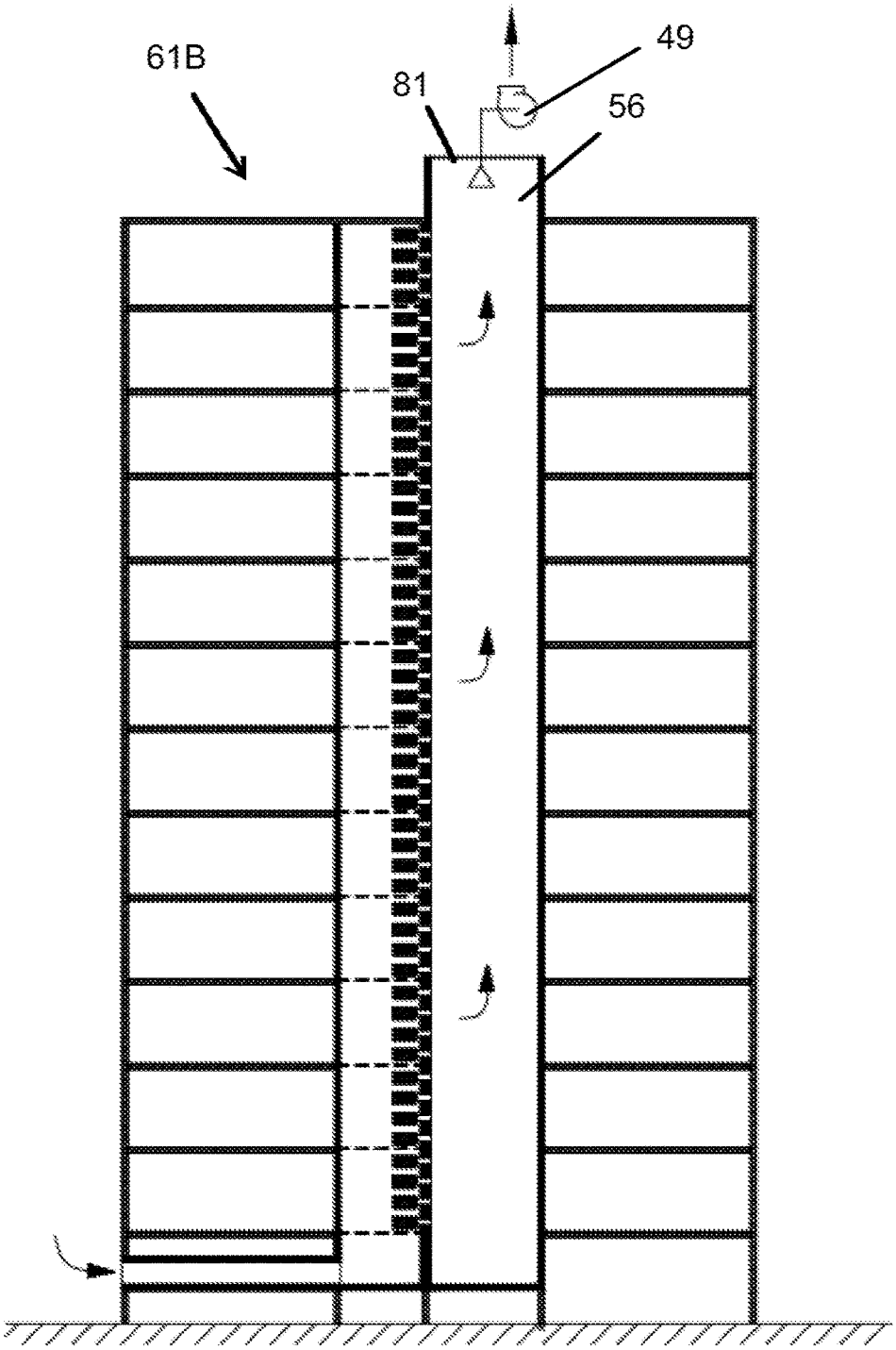

In building structure 61B shown in FIG. 11, which is similar to building structure 61A of FIG. 10, a discharge fan 49 located at the upper end 81 of exhaust shaft 56 assists in discharging the air from exhaust shaft 56 to the atmosphere.

Figure 12:
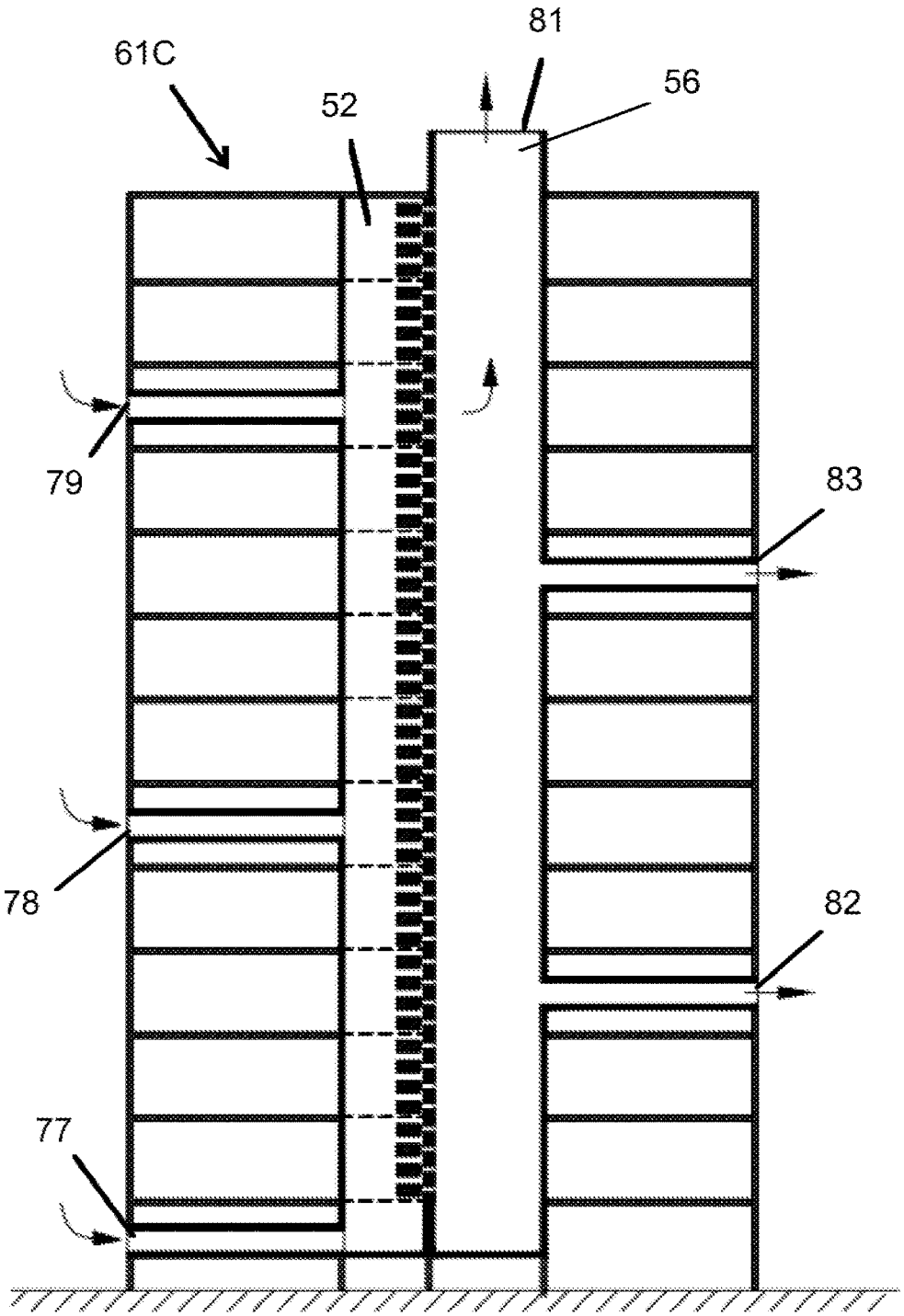

In building structure 61C shown in FIG. 12, which is similar to building structure 61A of FIG. 10, three vertically spaced air inlets 77-79 in communication with suction shaft 52 and three air outlets 81-83 in communication with exhaust shaft 56 are provided. The additional air inlets are used when it is anticipated that the power of the DCU fans will not be sufficient to overcome the pressure losses of the circulating air in shafts 52 and 56, and therefore will not provide the airflow requirements of some DCUs. Air outlets 82 and 83 discharge air to the side of the building at different heights, and air outlet 81 discharges air from the top of the building.

Figure 13:
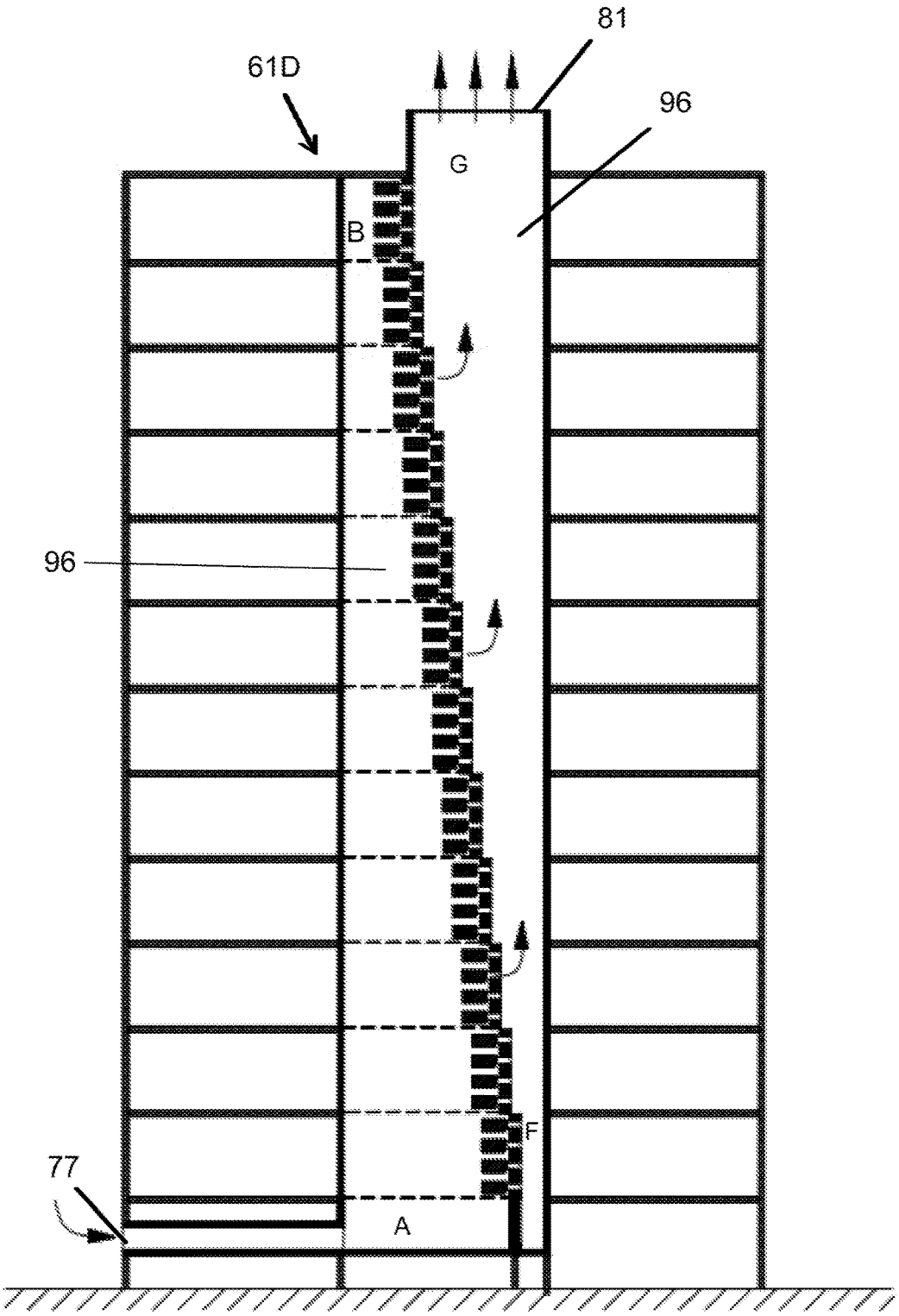

In building structure 61D shown in FIG. 13, both suction shaft 92 and exhaust shaft 96 are oblique. In this fashion, the increased cross-sectional area A of suction shaft 92 at its lower end in the vicinity of air inlet 77 relative to its decreased cross-sectional area B in the vicinity of the uppermost floor serves to increase the air flowrate within suction shaft 92 and to thereby ensure that the airflow needs of the DCUs at the upper stories of the building will be met. Conversely, the decreased cross-sectional area F of exhaust shaft 96 at its lower end relative to its increased cross-sectional area G in the vicinity of the uppermost floor is sufficient to receive the air discharged from a small number of DCUs, yet the width of exhaust shaft 96 gradually increases at higher stories to accommodate the higher capacity of upwardly flowing air that has been discharged from all the DCUs therebelow and has accumulated within the exhaust shaft.

Figure 14:
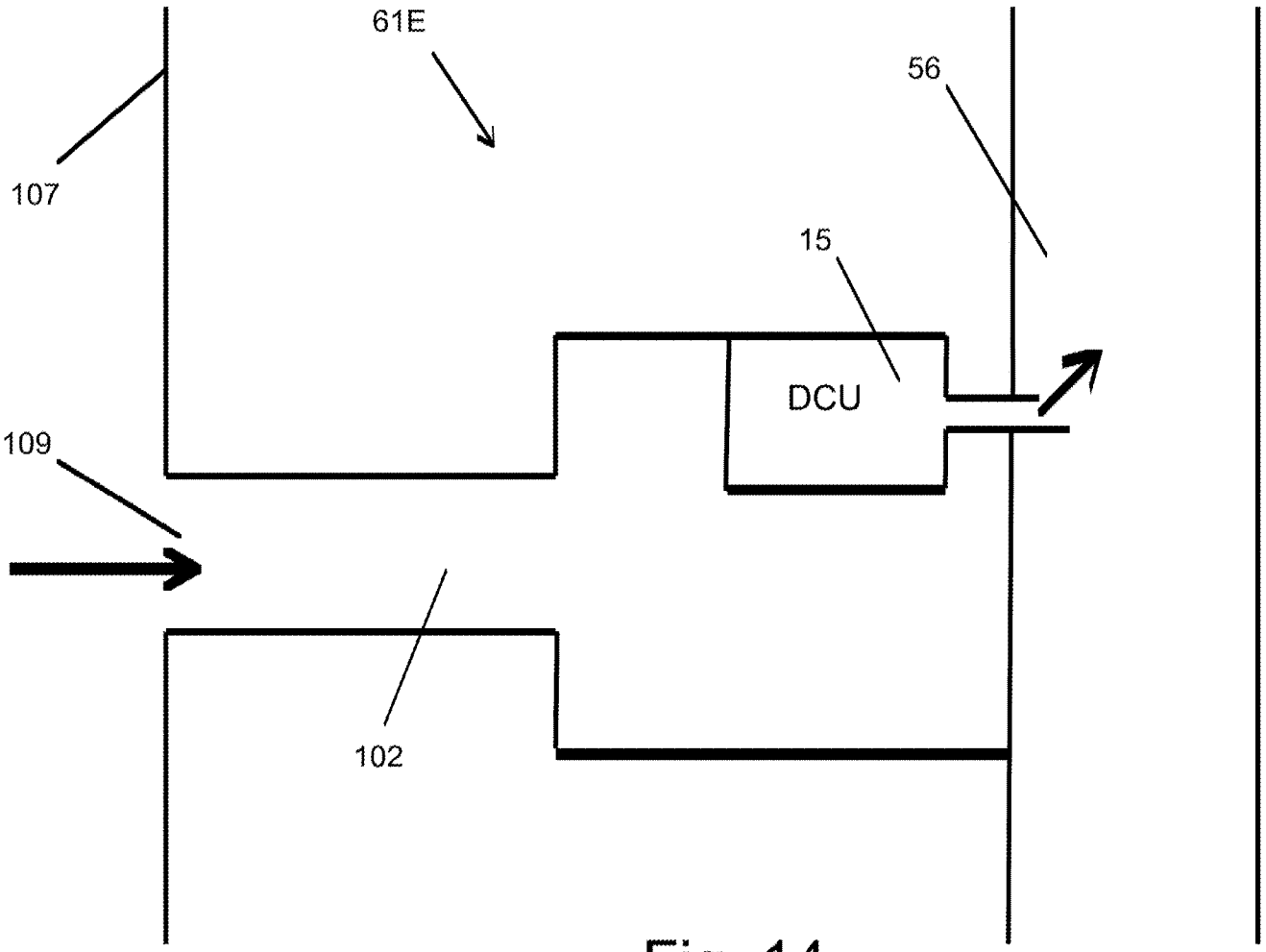
FIG. 14 is a schematic and partially illustrated vertical cross-sectional view of a building structure according to another embodiment of the invention.

The partially illustrated building structure 61E shown in FIG. 14 lacks a vertically extending suction shaft. In lieu of the suction shaft, a horizontal passageway 102 extending from a wall 107 of the building to vertical exhaust shaft 56 supplies a sufficient airflow to DCU 15, which is mounted within the passageway in such a way so to be concealed from view of those standing outside the building. The opening 109 made by passageway 102 within wall 107 may be formed with a dedicated shape that does not detract from the esthetic appearance of the building. Exhaust shaft 56 is common to all passageways 102 of the building, and receives the upwardly flowing air discharged from the DCUs.

It will be appreciated that a building structure may also envisioned that comprises a horizontal passageway extending from, and in fluid communication with, the suction shaft, to exhaust the air discharged from one or more DCUs mounted at a corresponding floor of the building.

FIGS. 15-25 illustrate the relative position of various shafts within a building.

Figure 15:
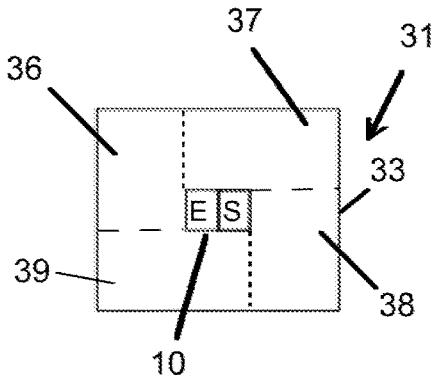

As shown in FIG. 15, building structure 31 is configured with a single central vertical shaft 10 that is completely isolated from the outer walls 33 of the building, such that enclosed areas 36-39, which may be used for residential or commercial purposes, completely surround shaft 10. As the condenser is mounted within shaft 10 and is not exposed to sunlight or to hot ambient temperatures, the refrigerant within the condenser may be able to achieve a lower temperature than a prior art externally mounted condenser, and therefore the air conditioning system will have an increased thermal efficiency and will be associated with lower operating costs.

Since the DCU is mounted within shaft 10, the outer walls 33 and rooftop of the building are unoccupied and uncompromised, leading to an esthetically appealing facade. Noise pollution is significantly reduced as the compressor and fan which constitute major sources of noise are now disposed internally within the building, the walls of suction shaft S and exhaust shaft E isolating the generated noise from the occupants of the building. A layer of acoustic insulation such as plasterboard to maintain a smooth airflow may be applied to suction shaft S and exhaust shaft E, in order to additionally dampen the generated noise and to thereby reduce the noise level for the building occupants.

Figure 16:
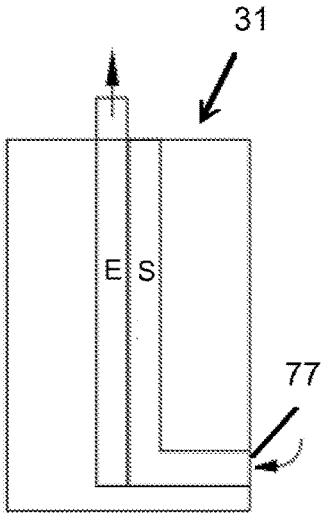

A schematic side view of building structure 31 including air inlet 77 is shown in FIG. 16. The building is shown to be rectilinear, but it will be appreciated that it, or any other building described herein, may assume any other desired shape or configuration, such as a curved shape. Similarly, suction shaft S and exhaust shaft E may assume any desired shape, configuration, or change in cross sectional area.

Figure 17:
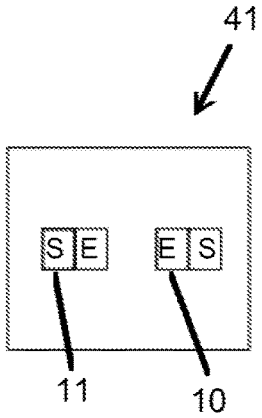

As shown in FIG. 17, a plurality of spaced pairs of suction and extract shafts, e.g. the two centrally located pairs 10 and 11, each of which facilitating fluid communication with one or two enclosed areas of a given floor, may be used with respect to building structure 41.

Figure 18:
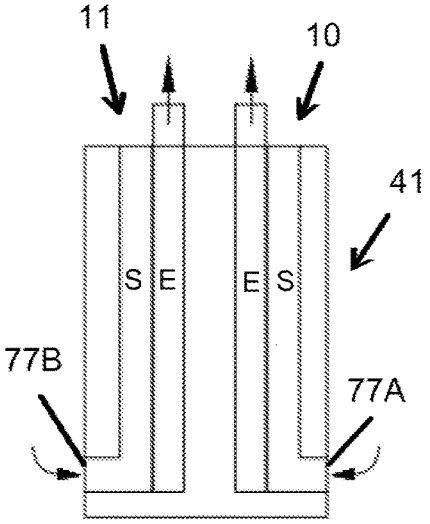

A schematic side view of building structure 41 is shown in FIG. 18. Air inlet 77A communicates with suction shaft S of pair 10, and air inlet 77B communicates with suction shaft S of pair 11.

Alternatively, as illustrated in FIGS. 19-22, the suction shaft and/or the exhaust shaft may adjoin an exterior wall of the building. The portion of the exterior wall adjoining the shaft may be coplanar with adjacent exterior wall portions, or alternatively may be recessed therefrom or protrude therefrom.

FIG. 19-21 illustrate building structure 111 configured such that both suction shaft S and exhaust shaft E of divided vertical shaft 10 adjoin the facade 7, in order to minimize the size of the shafts. A greater airflow rate is available to suction shaft S and exhaust shaft E that adjoin an exterior wall, and therefore their cross-sectional area may be significantly reduced without adversely affecting operation of the DCU. The size of air inlets and outlets may also be minimized, and the arrangement of these openings may be integrated with an overall architectural design that enhances the appearance of the building.

In prior art arrangements, outside condenser units are generally located behind louvers that are attached to the facade. These louvers permit flow of both intake and exhaust air that is needed for efficient operation of the condensers, and therefore require a minimum open area of 50%. The large surface area of the louvers results in an unsightly appearance. Since both intake and exhaust air flows across the same set of louvers, the exhaust air often infiltrates into the intake air, lowering the thermodynamic efficiency of the cycle due to the increased temperature of the intake air.

By use of the present invention whereby the suction shaft is separate from the exhaust shaft, and particularly when a non-return damper is used, the exhaust air is prevented from infiltrating into the intake air.

In addition, the size of the air inlets or outlets used in building structure 111 is considerably less than the size of the louvers used in prior art arrangements, and requires a total open area to be defined in an exterior wall of only 10-15%. The air inlets and/or air outlets may be louvered.

An exterior wall may be completely closed to further improve its esthetic appearance when the air inlet or outlet is at the top or bottom of the shaft.

Building structure 121 illustrated in FIGS. 22-24 is configured with a triparted vertical shaft 120 that adjoins facade 7. Vertical shaft 120 is arranged such that a common suction shaft CS is interposed between, and simultaneously transfers air to, two exhaust shafts E1 and E2.

The size of a shaft may be calculated based upon the number of DCUs that are installed therein and upon the airflow capacity of each DCU that dictates the total airflow. The total airflow for all DCUs is generally minimized by reliance on a diversity factor defining how many DCUs may be operated simultaneously. The diversity factor is based on a building program and on thermodynamic considerations. For example in a multi-tenant building, a typical diversity factor indicative of the percentage of DCUs that operate simultaneously at a given time is 70%.

For optimal performance and preliminary verification of the proper operation of the DCUs, a computerized flow dynamics (CFD) software simulation may be used. The CFD model takes various parameters of the air conditioning system into consideration, including a correct scale model of the building with:

Number of DCUs and their capacities, including air flow rates;

Operating and Non-operating DCUs;

Configuration, arrangement and cross sectional areas of the shafts; and

Configuration, arrangement and cross sectional areas of the inlet and outlet openings.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A multi-story building, comprising:

a) a first passageway constructed internally within said building and being configured with i. mounts for a plurality of ducted condenser units, each of said ducted condenser units being an outside unit of a split type, unitary air conditioning system; and ii. a plurality of sets of penetrations, each of said sets of penetrations dedicated to accommodate the extension therethrough of, and sized similarly as, a corresponding fluid circuit conduit through which refrigerant circulates between an inside unit and the outside unit associated with one of said ducted condenser units, b) a second passageway constructed internally within said building and in fluid communication with said first passageway to receive air discharged from each of said ducted condenser units, said second passageway terminating at a fanless opening of said building through which said discharged air is exhausted to the atmosphere; and c) each of said ducted condenser units, which comprises a compressor, a condenser and a fan for directing air flow within said first passageway towards said condenser in an unchanging direction, and a casing within which said compressor, condenser and fan are mounted, said casing being mounted by one or more of said mounts, wherein said first and second passageways have walls that are essentially closed, with the exception of the wall that adjoins said first and second passageways and that is formed with an opening through which said discharged air is flowable, wherein said first passageway is an upwardly extending suction shaft in fluid communication with at least one air inlet through which ambient air is introducible and said second passageway is an upwardly extending exhaust shaft, said first and second passageways upwardly extending across at least two stories of said building, wherein the fan of each of said ducted condenser units is a centrifugal fan which is operable to direct the air flow within said first passageway towards said condenser at an external static pressure ranging from 80 to 100 Pascal, to overcome pressure losses of the air circulating in said first and second passageways.

2. The multi-story building according to claim 1, wherein:

the exhaust shaft is in fluid communication with at least one air outlet from which the discharged air is exhaustible to the atmosphere, in addition to the opening at which the exhaust shaft terminates; or one or more of the ducted condenser unit mounts are provided at each different story of the building and the first and second passageways are in fluid communication with an enclosed area of said different story; or the suction and exhaust shafts extend along substantially the entire height of the building; or the suction and exhaust shafts are oblique, such that a lower end of the suction shaft has a greater cross-sectional area than at an upper end thereof, to increase the air flow rate within the suction shaft, and the exhaust shaft has a greater cross-sectional area at its upper end than at its lower end to accommodate the higher capacity of upwardly flowing air that has been discharged from all the ducted condenser units therebelow and has accumulated within the exhaust shaft.

3. The multi-story building according to claim 2, wherein the suction and exhaust shafts are in fluid communication with all floors of the building.

4. The multi-story building according to claim 1, which is additionally constructed with a volume disposed between, and in fluid communication with, the exhaust shaft and the suction shaft.

5. The multi-story building according to claim 1, which is additionally constructed with a horizontal passageway extending from an opening formed in a wall of the building to one of the first and second passageways.

6. The multi-story building according to claim 1, wherein the adjoining wall is thermally insulated.

7. The multi-story building according to claim 1, which is constructed with a service door for allowing entry to an interior of the first passageway.

8. The multi-story building according to claim 1, wherein the ducted condenser unit is mounted internally within the suction shaft.

9. The multi-story building according to claim 1, wherein the ducted condenser unit is mounted externally to the suction shaft.

10. The multi-story building according to claim 1, which is constructed with protective elements which are configured to prevent people who access the ducted condenser unit from falling within the first passageway, yet enable continuous and uninhibited flow of air within the first passageway.

11. The multi-story building according to claim 10, wherein the protective elements are embodied by a grating.

12. The multi-story building according to claim 11, wherein a dedicated cavity within which is mountable an exhaust duct of the ducted condenser unit is formed in the adjoining wall.

13. The multi-story building according to claim 12, wherein the exhaust duct is detachable from the ducted condenser unit casing, allowing a maintenance worker standing on the grating to access the ducted condenser unit fan via an uncovered discharge opening.

14. The multi-story building according to claim 1, wherein a non-return damper is mounted in an exhaust duct provided with each of the ducted condenser units, to prevent backflow of higher pressure discharged air.

15. The multi-story building according to claim 1, wherein one wall of the suction and exhaust shafts is common with an exterior wall of the building.

16. The multi-story building according to claim 15, wherein:

the wall of the suction and exhaust shafts that is common with an exterior wall of the building has a total open area of only 10-15%; or the wall of the suction and exhaust shafts that is common with an exterior wall of the building is completely closed, and an air inlet and air outlet of the suction and exhaust shafts, respectively, is at a top or bottom of the building; or the suction shaft is in fluid communication with first and second spaced exhaust shafts.

17. The multi-story building according to claim 1, wherein an air inlet of the first passageway is at a top or bottom of the building; or an air outlet of the second passageway is at a top or bottom of the building.

18. The multi-story building according to claim 1, wherein two or more of the ducted condenser units are mounted at each floor of the at least two stories of the building across which the first and second passageways upwardly extends.

19. The multi-story building according to claim 1, wherein the ducted condenser unit is used for heating water for use in enclosed areas of the building, a water-refrigerant heat exchanger being positioned in heat exchanger relation with high temperature refrigerant flowing thereto via a first heat exchanger conduit from the ducted condenser unit and with cool water flowing thereto via a second heat exchanger conduit from a water source so that heated water exiting said heat exchanger via a third heat exchanger conduit is flowable to a consumer, wherein heat depleted refrigerant returns to the ducted condenser unit via a fourth heat exchanger conduit.

20. A multi-story building, comprising:

a) a first passageway constructed internally within said building and being configured with i. mounts for a plurality of ducted condenser units, each of said ducted condenser units being an outside unit of a split type, unitary air conditioning system; and ii. a plurality of sets of penetrations, each of said sets of penetrations dedicated to accommodate the extension therethrough of, and sized similarly as, a corresponding fluid circuit conduit through which refrigerant circulates between an inside unit and the outside unit associated with one of said ducted condenser units, b) a second passageway constructed internally within said building and in fluid communication with said first passageway to receive air discharged from each of said ducted condenser units, said second passageway terminating at an opening of said building through which said discharged air is exhausted to the atmosphere, wherein said second passageway is configured with a mount for a discharge fan which is located proximate to said opening; and c) each of said ducted condenser units, which comprises a compressor, a condenser and a fan for directing air flow within said first passageway towards said condenser in an unchanging direction, and a casing within which said compressor, condenser and fan are mounted, said casing being mounted by one or more of said mounts, wherein said first and second passageways have walls that are essentially closed, with the exception of the wall that adjoins said first and second passageways and that is formed with an opening through which said discharged air is flowable, wherein said first passageway is an upwardly extending suction shaft in fluid communication with at least one air inlet through which ambient air is introducible and said second passageway is an upwardly extending exhaust shaft, said first and second passageways upwardly extending across at least two stories of said building, wherein the fan of each of said ducted condenser units is a centrifugal fan which is operable to direct the air flow within said first passageway towards said condenser at an external static pressure ranging from 80 to 100 Pascal, to overcome pressure losses of the air circulating in said first and second passageways.

* * * * *